US010286256B2

(12) United States Patent
Slobodnik

(10) Patent No.: US 10,286,256 B2
(45) Date of Patent: May 14, 2019

(54) WEIGHT EXERCISE MACHINE

(71) Applicant: Dmitriy Davidovich Slobodnik, Saint Petersburg (RU)

(72) Inventor: Dmitriy Davidovich Slobodnik, Saint Petersburg (RU)

( * ) Notice: Subject to any disclaimer, the term of this patent is extended or adjusted under 35 U.S.C. 154(b) by 0 days.

(21) Appl. No.: 16/046,445

(22) Filed: Jul. 26, 2018

(65) Prior Publication Data

US 2018/0369644 A1 Dec. 27, 2018

Related U.S. Application Data

(63) Continuation of application No. PCT/RU2017/000029, filed on Jan. 24, 2017.

(51) Int. Cl.
*A63B 21/00* (2006.01)
*A63B 23/12* (2006.01)
(Continued)

(52) U.S. Cl.
CPC ..... *A63B 24/0087* (2013.01); *A63B 21/0087* (2013.01); *A63B 21/00181* (2013.01); *A63B 21/4034* (2015.10); *A63B 21/4035* (2015.10); *A63B 21/4047* (2015.10); *A63B 23/03525* (2013.01); *A63B 23/1209* (2013.01);
(Continued)

(58) Field of Classification Search
CPC ..... A63B 24/0087; A63B 23/1245; A63B 21/4035; A63B 21/4034; A63B 21/00181; A63B 23/03525; A63B 21/4047; A63B 23/1209; A63B 21/0087; A63B 71/0622; A63B 2220/52; A63B 23/1263; A63B 2220/58; A63B 21/159; A63B 21/4029; A63B 2225/09; A63B 2225/093; A63B 2069/0062
See application file for complete search history.

(56) References Cited

U.S. PATENT DOCUMENTS 4,865,315 A 9/1989 Paterson et al.
5,254,066 A 10/1993 Brown et al.
(Continued)

FOREIGN PATENT DOCUMENTS

| | | |
|---|---|---|
| EP | 2263759 | 12/2010 |
| RU | 2050881 | 12/1995 |
| RU | 2516856 | 5/2014 |

OTHER PUBLICATIONS

PCT International Search Report dated Jun. 29, 2017 in corresponding PCT Application No. PCT/RU2017/000029, Dmitriy Davidovich Slobodnik, pp. 1-2.

*Primary Examiner* — Garrett K Atkinson
(74) *Attorney, Agent, or Firm* — McAfee & Taft

(57) ABSTRACT

The present invention relates to a weight exercise machine and training methods for development and strengthening of muscles and joints with exercises aimed for overcoming a counteracting force with or without measuring equipment, more specifically, to training devices and training methods with the eccentric phase of the training.
The weight exercise machine comprises a frame bearing a seat for a user, the seat fastened to the frame; a touch screen connected with a control unit for controlling training modes and monitoring training parameters; an actuator controlled by the control unit; and an interface interacting with the user. Thus, efficiency of weight training can be improved.

23 Claims, 2 Drawing Sheets

(51) Int. Cl.

| | |
|---|---|
| ***A63B 24/00*** | (2006.01) |
| ***A63B 69/00*** | (2006.01) |
| ***A63B 71/06*** | (2006.01) |
| ***A63B 21/008*** | (2006.01) |
| ***A63B 23/035*** | (2006.01) |

(52) U.S. Cl.

CPC ..... *A63B 23/1245* (2013.01); *A63B 71/0622* (2013.01); *A63B 21/159* (2013.01); *A63B 21/4029* (2015.10); *A63B 23/1263* (2013.01); *A63B 2069/0062* (2013.01); *A63B 2220/52* (2013.01); *A63B 2220/58* (2013.01); *A63B 2225/09* (2013.01); *A63B 2225/093* (2013.01)

(56) References Cited

U.S. PATENT DOCUMENTS 5,476,428 A 12/1995 Potash et al.
6,071,216 A * 6/2000 Giannelli ..... A63B 21/159 482/100
6,142,917 A * 11/2000 Giannelli ..... A63B 23/03533 482/100
6,254,516 B1 * 7/2001 Giannelli ..... A63B 23/1209 482/100
6,287,243 B1 * 9/2001 Isom ..... A63B 21/078 482/104
6,716,144 B1 4/2004 Shifferaw
7,364,535 B1 * 4/2008 Rosenow ..... A63B 21/4033 482/101
D612,437 S * 3/2010 Fenster ..... D21/675
D613,350 S * 4/2010 Fenster ..... D21/675
7,717,836 B1 * 5/2010 Miller ..... A63B 21/00 482/142
7,753,830 B1 * 7/2010 Marsh ..... A63B 21/078 482/104
2003/0092543 A1 * 5/2003 Giannelli ..... A63B 21/155 482/100
2005/0032614 A1 * 2/2005 Keiser ..... A63B 21/4029 482/142
2015/0148203 A1 * 5/2015 Rios Sodeyama ..... A63B 21/0083 482/112

* cited by examiner

WEIGHT EXERCISE MACHINE

CROSS-REFERENCE TO RELATED APPLICATIONS

This application is a continuation of International application PCT/RU2017/000029 filed on Jan. 24, 2017 which claims priority benefit to Russian patent application RU 2016102683 filed on Jan. 27, 2016. Each of these applications is hereby incorporated by reference for all purposes.

FIELD OF THE INVENTION

The present invention relates to training devices and training methods for development and strengthening of muscles and joints with exercises aimed for overcoming a counteracting force with or without measuring equipment, more specifically, to training devices and training methods with the eccentric phase of the training.

BACKGROUND OF THE INVENTION

An eccentric phase of training is the phase when a tight muscle is stretched under load. By eccentric contraction the muscle-tendon complex stretches and absorbs the mechanical energy. An extensive eccentric training causes a number of muscle adaptations that are advantageous for after-workout recovery and sports events. Muscles can generate a significantly greater eccentric force in comparison with a concentric force. In the eccentric phase, the force is generated by both contractile elements of muscle fibers and by viscoelastic components of connective tissue. At the same time, by concentric contractions the force is generated only by contractile elements.

While performing high intensity eccentric exercises, the muscle mass is increased due to the growth of fiber width and the quantity of sarcomeres, mainly, fibers of the II type. In contrast to the traditional concentric training with weights, hypertrophy happens earlier at the eccentric training. Researchers have found that the muscle stretching in the eccentric phase stimulates muscle protein synthesis better than the concentric contraction does.

High intensity eccentric exercises provide a significant increase in strength that is higher than by concentric exercises. Current scientific data for trained sportsmen show that the eccentric exercises effectively increase the strength. Further, an explosive strength can be increased. Taking into account that the muscular fatigue can be incomplete in the concentric exercises, the usage of eccentric phase can lead to higher fatigue of motor units in the body and thus create an additional stimulus to hypertrophy.

Regular eccentric exercises can increase contractile part of a muscle without visual length increase. As a result, two important changes of a muscle function happen: the speed of contraction increases; the force peak is developed earlier. This enables better protection of joints by muscles against damages which can be caused by quick movements because muscles begin to contract earlier, thus increasing the control over a movement. It is one of the reasons to recommend eccentric exercises for prevention of injuries and for rehabilitation.

Eccentric exercises also require much lower level of oxygen consumption and stress on the cardiovascular system as well as lower level of perceived load for any level of the complexity of exercises. Therefore, it was proved that eccentric exercises were the perfect choice for elderly people and people suffering from cardiovascular collapse as the eccentric exercises help to build up muscles quickly and safely, and significantly decrease injury risks without overloading the cardiovascular system.

There exists still a need for improving efficiency of weight training and for providing an exercise machine for this.

SUMMARY OF THE INVENTION

It is an object of the present invention to improve efficiency of weight training.

The object is achieved by creating a weight exercise machine comprising:

an interface interacting with a user, the interface is movable along a first stroke path corresponding to stretching a target muscle or a group of muscles of the user, and a second stroke path corresponding to contracting the target muscle or the group of muscles of the user, and a frame carrying:

an actuator having a moving part coupled to the interface, wherein the interface receives a force from the actuator, and a control unit for controlling the actuator such that, when moving along the first stroke path, the interface opposes the force applied by the user while, when moving along the second stroke path, the interface aids the user by creating a force sufficient for allowing the interface to move, at least partially, along the second stroke path without applying a muscle force of the user to the interface.

In one of the embodiments, the control unit controls at least one of an acceleration of the interface when moving, at least partially, along the stroke path and a length of the stroke path of the interface.

The control over said acceleration on at least on the part of the stroke and the length of the stroke provides the possibility of setting such stroke of interface that it allows to affect a specific (target) muscle or a group of muscles that improves the efficiency of the exercise and makes possible the usage of such exercise machine for the rehabilitation and recovery of muscles after injuries.

In one of the embodiments, the interface is provided with a strain gage transducer to transmit a signal to the control unit. Usage of the strain gage transducers configured to transmit the signal to the control unit allows to record and use for calculations the values of the force applied by the user.

In one of the embodiments, the control unit controls the interface based on the signal from the strain gage transducer.

In one of the embodiments, when moving along the second stroke path, the interface aids the user by that the control unit uses at least one of a weight of a body part of the user and a gravity force affecting the body part. This can improve efficiency of training.

In one of the embodiments the control unit measures at least one of the weight of the body part of the user and the gravity force affecting the body part, based on the signal from the strain gage transducer, when the user, while using the weight exercise machine and interacting with the interface, does not apply his/her muscle force developed by the body part to the interface; and the control unit measures the force created to aid the user, when moving along the second stroke path, based on at least one of the measured weight and the gravity force. This can improve efficiency of training.

In one of the embodiments, the control unit measures the force created to aid the user, when moving along the second stroke path, further based on at least one of the phase of the stroke and direction of the stroke of the interface. This can improve efficiency of training.

In one of the embodiments, the interface comprises two interface elements for interaction with limbs of the user, each limb bearing one strain gage transducer to transmit a signal to the control unit.

In one of the embodiments, the two interface elements are driven by two independent rods. Such solution allows measuring the resistance force of each user's limb and, based on these results, providing simultaneous travel of the interface with user's limbs.

In one of the embodiments, the opposing action is defined by at least one of the weight of the body part and the gravity force affecting the body part. This can improve efficiency of training.

The object is also achieved by a weight training method using the mentioned weight exercise machine, the method comprising:

by using the interface, opposing the force applied by the user, when moving along the first stroke path assigned for stretching the target muscle or the group of muscles of the user, and by using the interface, aiding the user by creating a force sufficient for allowing the interface to move, at least partially, along the second stroke path without applying the muscle force of the user to the interface, when moving along the second stroke path.

DETAILED DESCRIPTION

Figure 1:
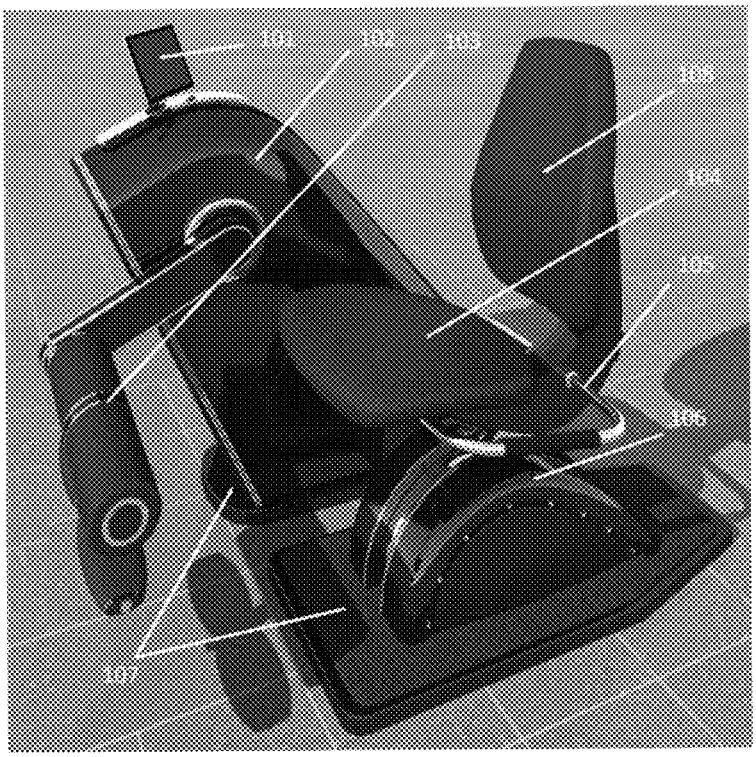
FIG. 1 shows a weight exercise machine for training anterior and posterior surfaces of the thigh.

According to one embodiment shown on the FIG. 1, the weight exercise machine for the training of anterior and posterior surfaces of the thigh comprises a frame hidden with a set of plastic housings. The base of the weight exercise machine is made in the form of H-shaped platform 107 that is a part of the frame and on one side of which a seat 104 for the user is mounted, which is made in such a way that the user can adjust its height and incline against the platform 107 with help of control drives located under a housing 106. There are two arched handles 105 for each arm of the user by a seat base made from metal tubes in the middle part of which there is a soft nonskid pad. The seat 104 is covered with a layer of rubber water-repellent material and has a back 108 covered with the same material. On the other side of the platform there is an inverted U-shaped part 102 of the frame that is hidden with a plastic housing under which the control unit and the actuator are located. The actuator transmits the force to an interface 103 interacting with the user via a crank mechanism. The actuator is a Festo electric cylinder ESBF whose piston transmits the force to the crank mechanism that has the interface 103 mounted on its axis of rotation. The interface 103 is an eccentric member, one of the ends of which is fastened on the axis of the crank mechanism and on the other end of which two rollers are fastened. The rollers are placed with a gap in horizontal and vertical directions relative to each other and their length and distance between them allow keeping in place both user's legs between them. The rollers are located on the axis that is parallel to the axis of rotation of the crank mechanism. The distance between the axis of the crank mechanism and the rollers location axis that corresponds to the user's shin length, can be adjusted in a known way. On the axis between the piston of the electric cylinder and the arm of the crank mechanism a strain gage transducer defining the force applied by the user to the eccentric member is fastened. The force is composed of the muscles force and the force defined by a user's body part that interacts with the interface 103, for example, via a leg weight. The strain gage transducer is connected with the control unit transmit the signal that corresponds to the amount of the force applied by the user to the eccentric member. The signal from the strain gage transducer can be recorded by the control unit in order to monitor forces applied by the user to the eccentric member. The control unit is a computing system to control drives and the actuator and to indicate the information on a touch screen 101 located on top of the inverted-U-shaped part of the frame over a plastic housing 102.

In one of the embodiments the user takes the seat 104, fixes legs between rollers located on the interface 103 in the form of the eccentric member, and adjusts the parameters of the weight machine for his needs, using the touch screen 101. These parameters can include: incline of the seat, height of the seat, incline of the backrest, shin length and so on. One of these parameters is the weight of user's legs measured with help of the strain gage transducer in a position when, using the exercise machine, the user does not affect interface 103 with the muscles force, and the effect applied to the interface equals to the attractive force of legs to the Earth (the gravity force affecting legs). At that, the user additionally exerts on the means 103 force that is defined by the weight of a corresponding body part. Also it should be noted that the amount of such effect can vary from the amount of the gravity force applied to a corresponding body part and defined by an indicated weight, to the fraction of the amount of this the gravity force less than unity, depending on the phase of the stroke of the mean 103 of interaction with the user and the type of the exercise machine. Depending on the type of the exercise machine, the weight of different user's body parts can change. In some embodiments, together with the weight of a body part or in addition to it, the gravity force applied to this body part can be measured. The parameters can be recorded in a memory storage of the control unit for further trainings in the form of, for example, a profile of a specific user, in order to have the possibility for the user to select a necessary set of individual parameters recorded in the memory storage. After identification of the user with loading of a stored profile or adjusting the parameters, the user can select a training plan depending on one of the goals: increasing of muscle strength in the concentric phase, increasing of muscle strength in the eccentric phase, increasing of muscle strength in the mixed phase, knock-up and so on. Also, it is provided the possibility of independent adjustment of concentric and eccentric phases; in particular acceleration on the whole length of the stroke of the interface 103 or their part can be adjusted by the user or preset in accordance with selected training plan. The adjustment includes in particular cutoff of the load applied to the user in any phase and also in any part of the stroke of the interface 103. All said actions can be made with help of a touch screen 101. After selecting training modes and adjusting exercises for the training of the anterior surface of the thigh in the eccentric phase, the user will be warned about moving of the interface 103 in the initial state—legs are straightened in knees. When the interface 103 are moved in the initial state, the execution of exercises begins. In this training mode the user feels pressure in the fore part of a shin of a straightened leg. The user's task is to resist to this pressure on along the entire section of the stroke of the interface 103 from the position when legs are fully straightened to the position when legs are bent in knees. After passing this section, the exercise machine will return user's legs in the initial position without user's help. If the system detects resistance from the user, the screen will show a notification that physical activity shall be stopped. The detection of opposing resistance from the user in such embodiment of the exercise machine is realized by analysis of the control unit of the signal from the strain gage transducer considering measured weight of user's legs. For example, when moving the interface 103 from the position where legs are bent in knees, the influence of legs weight increases with the increase of the rotation angle of the eccentric member towards the direction where legs are straightened in knees. Thus, the control unit calculates the value of influence of the weight of legs depending on a known rotation angle of the eccentric member and takes this value into account by measuring resistance from the user.

In one of the embodiments, the control unit deducts the value of force defined by measured weight of user's legs, with a correction for the eccentric rotation angle, from a defined value of user's force by affecting the interface 103 in a corresponding phase of the stroke of the interface. If the obtained value exceeds a predetermined limit, the control unit identifies user's resistance and shows a corresponding notification on the touch screen. The limit can be set in the proportion of the gravity force affecting legs, for example, 0.05 of the gravity force. Any suitable limit value can be used. In one of the variants of realization, the limit can be set to zero.

In another embodiment, the control unit can define the ratio of defined value of user's force on the interface 103 in a corresponding phase of the stroke of the interface to the force defined by measured weight of user's legs with a correction for an eccentric rotation angle. If the obtained value is more than a predetermined limit, the control unit identifies user's resistance and shows a corresponding notification on the touch screen. The limit can be set as a numerical value, for example, 1.05. Any suitable limit value can be used. In one of the embodiments, the limit can be set to 1.

In another embodiment the actuator can be represented in the form of a gear motor made configured to transmit the force to the interface with the user with help of a belt drive. Also in this embodiment the gear motor can have an output axis angle transducer.

In some embodiments the gravity force is measured instead of weight. Consequently, the control unit defines the force value defined by measured gravity force, effecting user's legs, with the correction for an eccentric rotation angle, instead of defining the effect value defined by measured weight of user's legs with the correction for an eccentric rotation angle. The further actions are performed similar to abovementioned embodiments.

The control over the strain gage transducer signal allows to define force applied by the user on the part of the stroke of the interface 103 where the force from the user shall be applied, and to record in the control unit values of these forces in order to monitor forces applied by the user.

Figure 2:
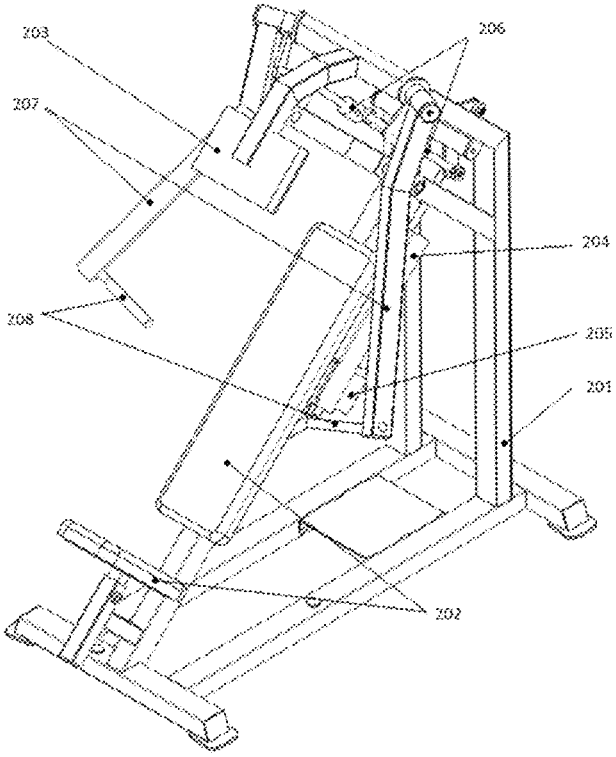
FIG. 2 shows an isometric view of a weight exercise machine for training chest muscles.
Figure 3:
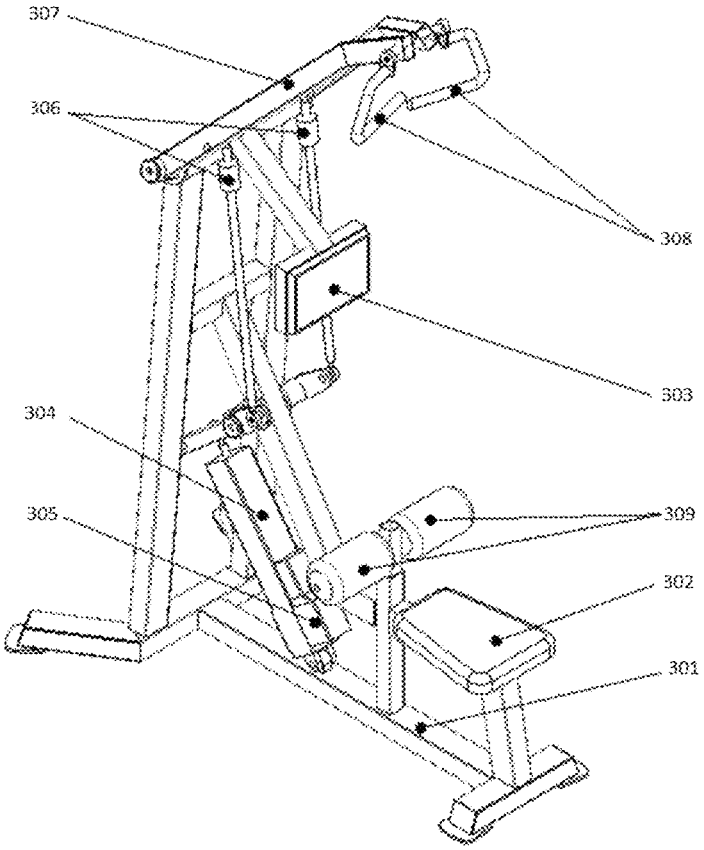
FIG. 3 shows an isometric view of a weight exercise machine for training back muscles.

According to another embodiment presented on the FIG. 2, the weight exercise machine for the chest training comprises a frame 201 on which a seat 202 for the user is fastened, a touch screen 203 connected with a control unit 205 designed for the control over training modes and the monitor of training parameters, an actuator 204 controlled by the control unit 205, interface with the user that include two elements for interaction with the user in the form of arched levers 207 with fixed handles 208 on them for the user and strain gage transducers 206. In this embodiment each lever 207 has one strain gage transducer 206 on it. Each strain gage transducer independently defines the force applied by the user to a corresponding lever, and transmits the signal to the control unit. For example, the control unit receives information about release of the force applied by the user to one of the levers, and generates the signal for the user, that is shown on the touch screen 203, about insufficiency of the force applied by the user. In another embodiment, the control unit receives information about redundancy of the force applied by the user to one of the levers. Separately measuring of forces applied to each lever by the user increases accuracy of the reaction of the weight exercise machine to user's actions and therefore the effectiveness and safety of interaction of the user with the weight exercise machine. It should be mentioned that depending on appliance, the direction of change of counteracting force (intensification or relaxation) depending on the change of the force applied by the user (intensification or relaxation), can be different and is realized similar to the abovementioned example. Moreover, the control over change of assisting effect, depending on the measured force applied by the user, can be realized.

Also signals from strain gage transducers can be recorded by the control unit to monitor the force applied by the user.

According to another embodiment, presented on the FIG. 2, the weight training machine for back training comprises a frame 301, on which a seat 302 for the user is fastened, a touch screen 303 connected with a control unit 305, designed for controlling over training modes and monitoring training parameters, an actuator 304 controlled by the control unit 305, an interface interacting with the user that include two elements for interaction with the user in the form of arched levers 307 with fixed handles 308 on them for the user and strain gage transducers 306 and rollers 309.

In one embodiment the user using the weight exercise machine can adjust the actuator control unit in such a way that some exercise partials can be repeated, in other words, the interface can pass not the full stroke. Such repetitions can be added in the end of a training realizing so called forced repetitions. Another variant of usage of an incomplete stroke of the interface is the possibility of affecting specific muscles or part of user's muscles. For example, while executing the exercise in 10-12 cm of the stroke of the interface on the weight exercise machine, it is possible to affect only tendons of the anterior surface of the thigh. Thus, the weight exercise machine can be adjusted for work with a specific muscle or a group of muscles for working on a damaged limb.

In one embodiment the user can set acceleration of interface with the user in different ways depending on a section of the stroke of the interface. For example, to set 10% of maximal acceleration on the first part that is equal to ⅕, 30% on the last ⅕ of the stroke and 100% in the middle of the stroke of the interface. So the user can reduce the load on tendons in the beginning and in the end of the exercise.

Although the present description contains some preferable embodiments, they are not limiting and are given as an example. The scope of the invention is not limited by the given examples; rather it is defined only by the below claims.

What is claimed is:

1. A weight exercise machine comprising:

an interface interacting with a user, the interface is movable along a first stroke path corresponding to stretching a target muscle or a group of muscles of the user, and a second stroke path corresponding to contracting the target muscle or the group of muscles of the user, and a frame carrying:

an actuator having a moving part coupled to the interface, wherein the interface receives a force from the actuator, and a control unit for controlling the actuator such that, when moving along the first stroke path, the interface opposes the force applied by the user while, when moving along the second stroke path, the interface aids the user by creating a force sufficient for allowing the interface to move, at least partially, along the second stroke path without applying a muscle force of the user to the interface.

2. The weight exercise machine of claim 1, wherein the control unit controls at least one of an acceleration of the interface when moving, at least partially, along the stroke path, and a length of the stroke path of the interface.

3. The weight exercise machine of claim 1, wherein the interface is provided with a strain gage transducer to transmit a signal to the control unit.

4. The weight exercise machine of claim 3, wherein the control unit controls the interface based on the signal from the strain gage transducer.

5. The weight exercise machine of claim 3, wherein, when moving along the second stroke path, the interface aids the user by that the control unit uses at least one of a weight of a body part of the user and a gravity force affecting the body part.

6. The weight exercise machine of claim 5, wherein the control unit measures at least one of the weight of the body part of the user and the gravity force affecting the body part, based on the signal from the strain gage transducer, when the user, while using the weight exercise machine and interacting with the interface, does not apply his/her muscle force developed by the body part to the interface; and the control unit measures the force created to aid the user, when moving along the second stroke path, based on at least one of the measured weight and the gravity force.

7. The weight exercise machine of claim 6, wherein the control unit measures the force created to aid the user, when moving along the second stroke path, further based on at least one of the phase of the stroke and direction of the stroke of the interface.

8. The weight exercise machine of claim 1, wherein the interface comprises two interface elements for interaction with limbs of the user, each limb bearing one strain gage transducer to transmit a signal to the control unit.

9. The weight exercise machine of claim 8, wherein the two interface elements are driven by two independent rods.

10. The weight exercise machine of claim 6, wherein the opposing action is defined by at least one of the weight of the body part and the gravity force affecting the body part.

11. A method of weight training using the weight exercise machine according to claim 1, the method comprising:

by using the interface, opposing the force applied by the user, when moving along the first stroke path assigned for stretching the target muscle or the group of muscles of the user, and by using the interface, aiding the user by creating a force sufficient for allowing the interface to move, at least partially, along the second stroke path without applying the muscle force of the user to the interface, when moving along the second stroke path.

12. The method of claim 11, further comprising measuring the force applied by the user to the interface.

13. The method of claim 12, further comprising controlling the interface based on the measured force.

14. The method of claim 11, wherein the user is aided based on at least one of the weight of the body part of the user and the gravity force affecting the body part.

15. The method of claim 11, further comprising measuring at least one of the weight of the body part of the user and the gravity force affecting the body part when the user, while using the weight exercise machine and interacting with the interface, does not apply his/her muscle force developed by the body part to the interface; and measuring the force created to aid the user based on at least one of the measured weight and the measured gravity force affecting said body part.

16. The method of claim 15, wherein measuring the force created to aid the user is further based on at least one of the phase of the stroke and direction of the stroke of the interface.

17. The method of claim 11, control comprising controlling at least one of an acceleration of the interface when moving, at least partially, along the stroke of the interface and a length of the stroke path of the interface.

18. The method of claim 12, wherein opposing the force applied by the user is controlled based on the measured force applied by the user to the interface.

19. The method of claim 18, further comprising separately measuring the force applied by each limb of the user to the interface.

20. The method of claim 18, wherein opposing the force applied by the user is controlled based on at least one of the weight of the body part of the user and the gravity force affecting the body part.

21. The weight exercise machine of claim 4, wherein, when moving along the second stroke path, the interface aids the user by that the control unit uses at least one of a weight of a body part of the user and a gravity force affecting the body part.

22. The method of claim 12, further comprising measuring at least one of the weight of the body part of the user and the gravity force affecting the body part when the user, while using the weight exercise machine and interacting with the interface, does not apply his/her muscle force developed by the body part to the interface; and measuring the force created to aid the user based on at least one of the measured weight and the measured gravity force affecting said body part.

23. The method of claim 19, wherein opposing the force applied by the user is controlled based on at least one of the weight of the body part of the user and the gravity force affecting the body part.

* * * * *